US006927724B2

(12) United States Patent
Snaper

(10) Patent No.: US 6,927,724 B2
(45) Date of Patent: Aug. 9, 2005

(54) ADAPTIVE MODIFICATION OF SURFACE PROPERTIES TO ALTER THE PERCEPTION OF ITS UNDERLYING STRUCTURE

(76) Inventor: Alvin A. Snaper, 2800 Cameo Cir., Las Vegas, NV (US) 89107

( * ) Notice: Subject to any disclaimer, the term of this patent is extended or adjusted under 35 U.S.C. 154(b) by 0 days.

(21) Appl. No.: 10/660,295

(22) Filed: Sep. 10, 2003

(65) Prior Publication Data

US 2005/0052310 A1 Mar. 10, 2005

(51) Int. Cl.[7] ..... H01Q 17/00; F41H 3/00; B63G 8/34; B63G 13/02

(52) U.S. Cl. ..... 342/3; 342/1; 342/13; 342/14; 428/919; 114/15; 89/1.11; 89/36.01; 89/36.02

(58) Field of Search ..... 342/1–14, 16, 342/175, 195; 89/1.11, 36.01–36.17; 114/15; 219/465.1; 428/17, 919

(56) References Cited

U.S. PATENT DOCUMENTS

| | | | | | |
|---|---|---|---|---|---|
| 3,431,348 | A | * | 3/1969 | Lamp et al. | 342/1 |
| 3,781,523 | A | * | 12/1973 | Boron | 219/465.1 |
| 4,560,595 | A | * | 12/1985 | Johansson | 428/17 |
| 5,080,165 | A | * | 1/1992 | Engelhardt | 342/3 |
| 5,523,757 | A | * | 6/1996 | Resnick | 342/1 |
| 5,734,495 | A | * | 3/1998 | Friedman | 428/919 |
| 5,847,672 | A | * | 12/1998 | James | 342/5 |
| 6,335,699 | B1 | * | 1/2002 | Honma | 342/4 |
| 6,338,292 | B1 | * | 1/2002 | Reynolds et al. | 89/36.02 |

* cited by examiner

*Primary Examiner*—Bernarr E. Gregory
(74) *Attorney, Agent, or Firm*—Donald D. Mon

(57) ABSTRACT

Adaptive modification of surface properties such as color, temperature and reflective properties by adjustably varying the temperature of a surface perceived by an observer, utilizing Peltier devices at the surface for temperature adjustment.

7 Claims, 3 Drawing Sheets

ADAPTIVE MODIFICATION OF SURFACE PROPERTIES TO ALTER THE PERCEPTION OF ITS UNDERLYING STRUCTURE

FIELD OF THE INVENTION

Adaptively modifying properties of a viewed surface to change the perception of its underlying structure.

BACKGROUND OF THE INVENTION

Many of the definitive characteristics of a structure are perceived by a viewer or investigative system by properties of its surface. While the surface characteristics may be entirely different from characteristics of the underlying structure, still they at least suggest to the observer significant information about the structure itself.

For example, a coat of paint on the chassis of a vehicle says something about the shape and color of the coat of paint on the vehicle, but it says nothing about the metal skin on which it is laid, except for its outer shape and color assuming that the paint is a uniform layer. Similarly it says nothing about an engine or anything else inside of it or inside an overlaying or shrouding skin. Thus, the characteristics of a surface which is directly viewed by the observer convey all of the information available to the observer. Changing these characteristics can change the observer's perception of the structure itself.

For example, in visible light, color patterns in a coat of paint may be of considerable interest. National emblems, cautionary displays, distracting or misleading images, and colors that do or do not contrast with the background are examples. Some colors may be intended to be glaringly obvious, while others are preferred to fade into the background. The art of color camouflage exemplifies one field of presenting a colored surface that is hopefully hidden in plain sight.

The above relates to reactions to visible light which light is emitted by, or which is reflected from the surface. This is only one example of means to perceive a structure. Other means which are pertinent to this invention are responses to frequencies outside of the visible spectrum, for example infrared and radar frequencies. For these, observation devices vary from reception of frequencies emitted or which are reflected by the surface itself, namely its infrared emission, or received (or modified) reflection of radar frequencies originated by the observing device which are reflected by the surface.

It is an object of this invention adaptively to change significant properties of the surface of a structure, by altering the emissive properties of the surface itself, or by altering its reflective properties. In both of these circumstances an observing device or person will be convinced to perceive pertinent properties that are not necessarily those of the underlying structure.

Reduced to absurdity, a structure may be camouflaged by repainting it, or by painting over indicia, for example. But then this arrangement remains until a next coat of paint is applied. Desert vehicles are painted once. If they are sent to the Arctic, they may be painted another color. But when they are in one place, their perceived color pattern is established and does not change.

In contrast, this invention proposes to alter surface properties literally on demand, between at least two different conditions. In this specification, the "perceived surface" is the interface with the atmosphere which is sensed by an observer. Its properties are determined by its immediate substrate. For example, the perceived surface of a coat of paint possesses properties determined by its substrate paint. A coating that does not alter the characteristics being observed is not regarded as the perceived surface for purposes of this invention.

This invention utilizes the effect of temperature of the perceived surface to alter the observed characteristics. For adaptive purposes, if temperature is the sensed property, the alternating property is the temperature itself. If color or some other reflected observable property is to be sensed, then a temperature-responsive substance is used for the exposed surface, with a substrate whose temperature can be changed. Of course, the surface may itself be the boundary of a substrate of the same material, for example a coat of paint. Thermochromic films or layers for change of colors, and embedded radar absorbing particles whose size changes with temperature to vary reflection or adsorption of radar frequencies are examples.

The change of temperature is achieved by the use of the well-known Peltier effect, in which a lower temperature is created on one side of a semi-conducting array or layer, and an elevated temperature on the opposite side. This essentially is the transfer of caloric heat to or from the first surface, (usually the exposed surface) to an underlying substrate or structure. The temperature of the exposed surface can thereby be changed, either increased or decreased, by current applied to the device, and the direction of the effect. To increase the effect, one merely increases the current density. Thus, by the mere exertion of an electrical current, the temperature, and with it the perception of a surface, can adaptively be adjusted and changed. Such devices are frequently used as "thermoelectric coolers" (TEC).

With the change in temperature of the exposed surface, its visible or emission properties can be changed, resulting in confusion of the observer.

BRIEF DESCRIPTION OF THE INVENTION

This invention utilizes the Peltier effect to control the temperature of a perceived surface. The controlled temperature is determined by the intensity and direction of the electrical current applied to the Peltier device.

According to this invention the Peltier device is applied as a surface on or spaced from an underlying structure or substrate that is shielded from direct observation by the Peltier device itself.

The device itself may be the directly observed surface or it may carry on it or have applied to it a cover such as paint which will share the controlled temperature. This cover may itself have thermochromic properties that are specifically visually observed, or radar-frequency reflective or absorptive properties that are specifically reflected or absorbed, the reflection being the observed property.

The perceived surface need not itself be a contiguous part of the underlying structure. For example it might be sufficiently spaced from the underlying structure (such as a jet engine tail pipe), that its own surface temperature is not unduly associated with the tailpipe temperature, but it is seen by the observer (for example by a heat-seeking missile) as the structure itself. Of course it must be suitably spaced from, or suitably insulated from, such hot gases or surfaces that might melt or otherwise hamper the Peltier device.

DETAILED DESCRIPTION OF THE DRAWINGS

Figure 3:
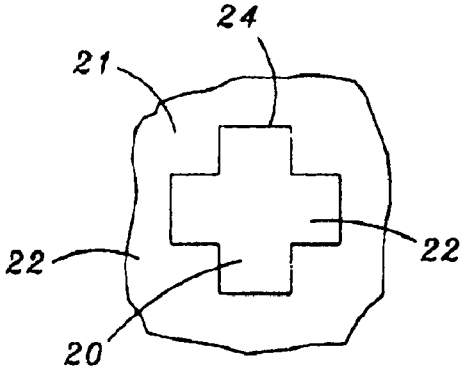
FIGS. 3 and 4 are fragmentary conceptual views showing two observed conditions.
Figure 4:
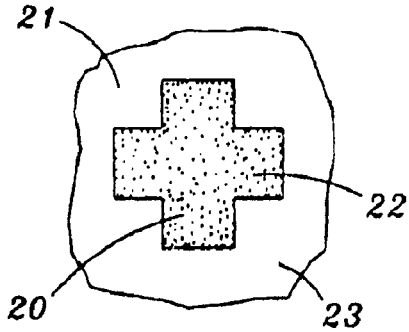

As an example of the intended effect of this invention FIGS. 3 and 4 show two different colorations on a surface 21. Surface 21 includes a patterned area 22 and a background area 23. At normal temperatures, for example atmospheric temperature between perhaps 70–110 degrees, the surface color, of areas 22 and 23 will be the same. A visual observer will perceive the entire surface as a single-colored continuum. The outline 24 of patterned area 22 is shown schematically. It is not a visible line.

When this invention is utilized and the patterned area 22 is thermochromic, this area became visible in some color different from the background area 23. A cross thereby became visible, while the color of background area 23 remained unchanged.

This is an example of a visible camouflage. It is equally possible for the cross to be visible at atmospheric temperature, but to disappear when heated or chilled to change the temperature of the viewed surface. Persons skilled in camouflage will readily recognize the advantages this will provide. Entire vehicles can change color or color patterns to agree with their surroundings, for example.

The purpose of FIGS. 3 and 4 is to illustrate the use of this invention to modify the perception of a surface locally, or over broad surfaces. It is also useful as a shield to conceal or confuse something inside it.

Figure 5:
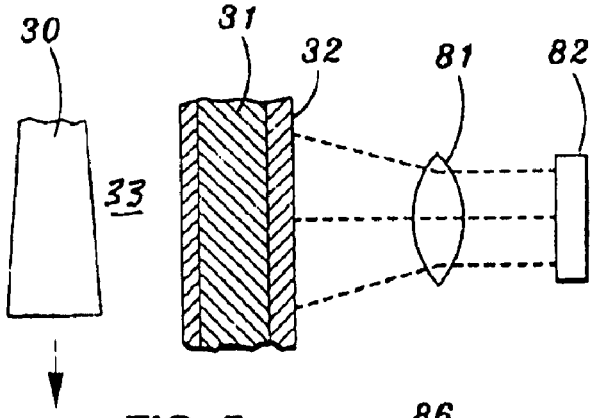
FIG. 5 is a schematic side view, partly in cross section, showing a use for this invention.

For example, FIG. 5 schematically shows a jet engine tail pipe 30 which is notoriously hot, and is an identifiable target for heat seeking missiles. The missiles seek the infra-red source, namely the hot tail pipe. FIG. 5 also shows a shield 31 according to this invention with a perceived surface 32 equipped with this invention as will be described.

Of course this shield cannot be directly applied to the hot tail pipe. Instead it will be spaced from it by a spacing 33 which insulates it from heat damage. If desired, insulation material (not shown) can be placed between them, instead of merely an air gap.

Figure 2:
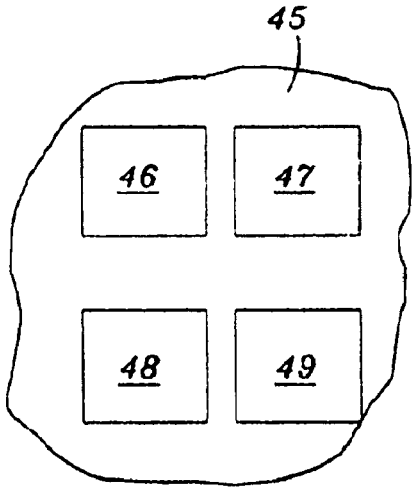
FIG. 2 is a plan view showing a plurality of devices according to FIG. 1 installed as a group.

The mode of employing this invention is schematically shown in FIG. 2. This illustrates a region 45 in which a group of Peltier devices 46, 47, 48, 49 are planted or applied. These are shown to be rectangular although they could instead have any desired contour. Also they are illustrated as planar bodies, although they can be curved or otherwise configured.

While they are shown spaced apart, generally they will be quite close to one another. All will have circuit connections connecting to a control yet to be described. It will be observed that these devices may be separately controlled, individually or in groups, to provide for various surface appearances. For example, some areas may need to be colder than others, especially when a coating might have more than one pertinent color which can be selected by a respective temperature.

Figure 1:
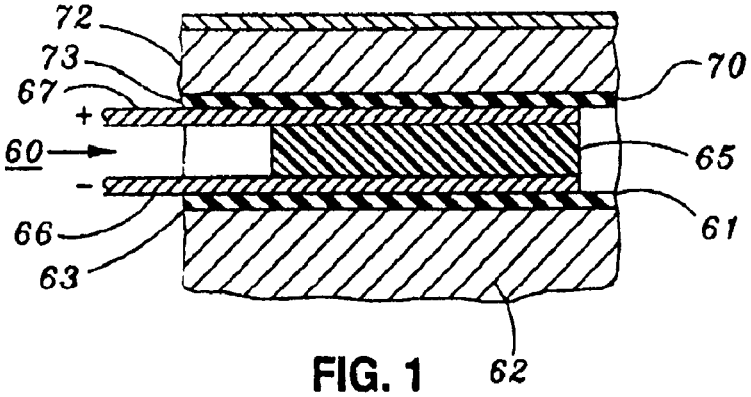
FIG. 1 is a fragmentary cross-section of a Peltier device installed according to this invention.

FIG. 1 is a fragmentary cross-section of a Peltier device 60 (sometimes herein referred to as a thermoelectric cooler—TEC). It is installed on the surface 61 of a substrate 62 whose perception is to be changed. A layer 63 of electrical insulation is placed on surface 61.

A thermoelectric semiconductor 65 is placed between two electrical conductors 66, 67, which are arranged as not to contact each other, because they become heat sinks as well as the supply of electrical current to the thermoelectric semiconductor.

A layer 70 of electrical insulation overlays this arrangement. The material whose temperature is to be controlled may be a layer 72 of thermochromic paint whose color is to be controlled. Alternatively, an interim thermally conductive layer (not shown) of material protective of the Peltier device may be placed between the paint and the insulation.

A thin protective layer 73 may be laid on the paint or other responsive surface if desired.

FIG. 5 is directed to presenting a different emitted property such as color or temperature as viewed by a viewing device 80 through a lens 81 or collector.

Figure 6:
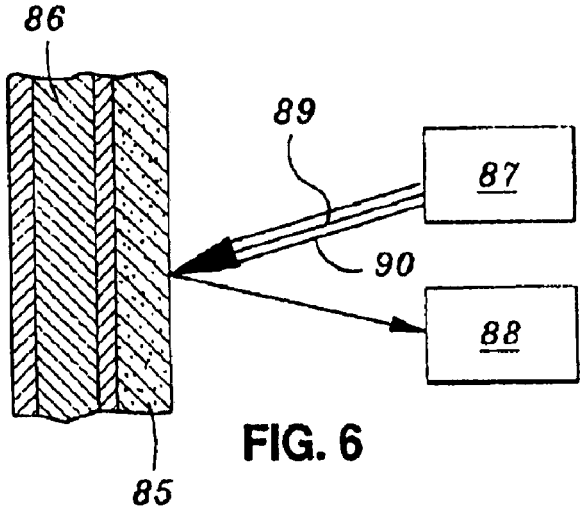
FIG. 6 is a view similar to FIG. 5 showing another use for this invention.

FIG. 6 is directed to presenting a different reflective property such as a changed frequency or absorbed frequency. A thermally responsive layer 85 is applied to a TEC layer 86. It receives energy from a source 87 such as a radar transmitter, and reflects energy to a receiver 88. The properties of the received beam 89 and the reflected beam 90 are different, having been modified by the thermally-responsive layer. The composition of thermally responsive layer 85 will be described in more detail below.

The TEC may be formed in shapes other than flat. They may be curved to conform to the shape of a substrate, or even, as shown in FIGS. 7 and 8 be made in the form of circular rods, wires, or as flexible threads or strings which can be woven into fabrics.

Figure 7:
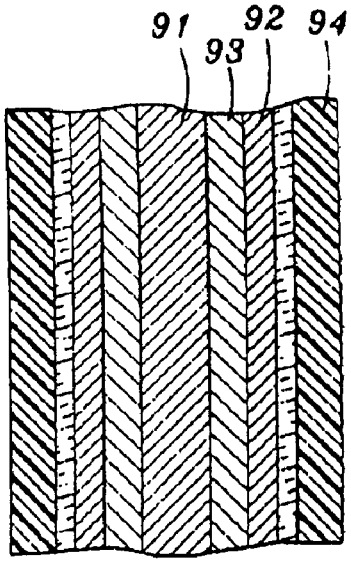
FIG. 7 is an axial cross-section of another embodiment of this invention.
Figure 8:
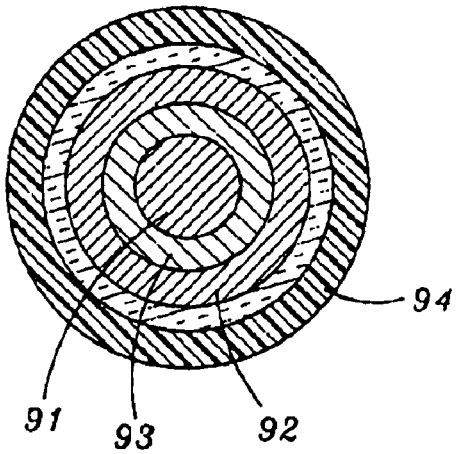
FIG. 8 is a cross-section taken at line 8—8 in FIG. 7.

A typical example is shown in FIG. 7, showing a wire having a central conductor 91, a surrounding thermoelectric semiconductor 92, an electrical insulator 93, and a surrounding thermochromic layer 94. The conductor acts as a heat sink. The outer layer of the thermoelectric semiconductor can change the temperature of the thermochromic layer.

Figure 9:
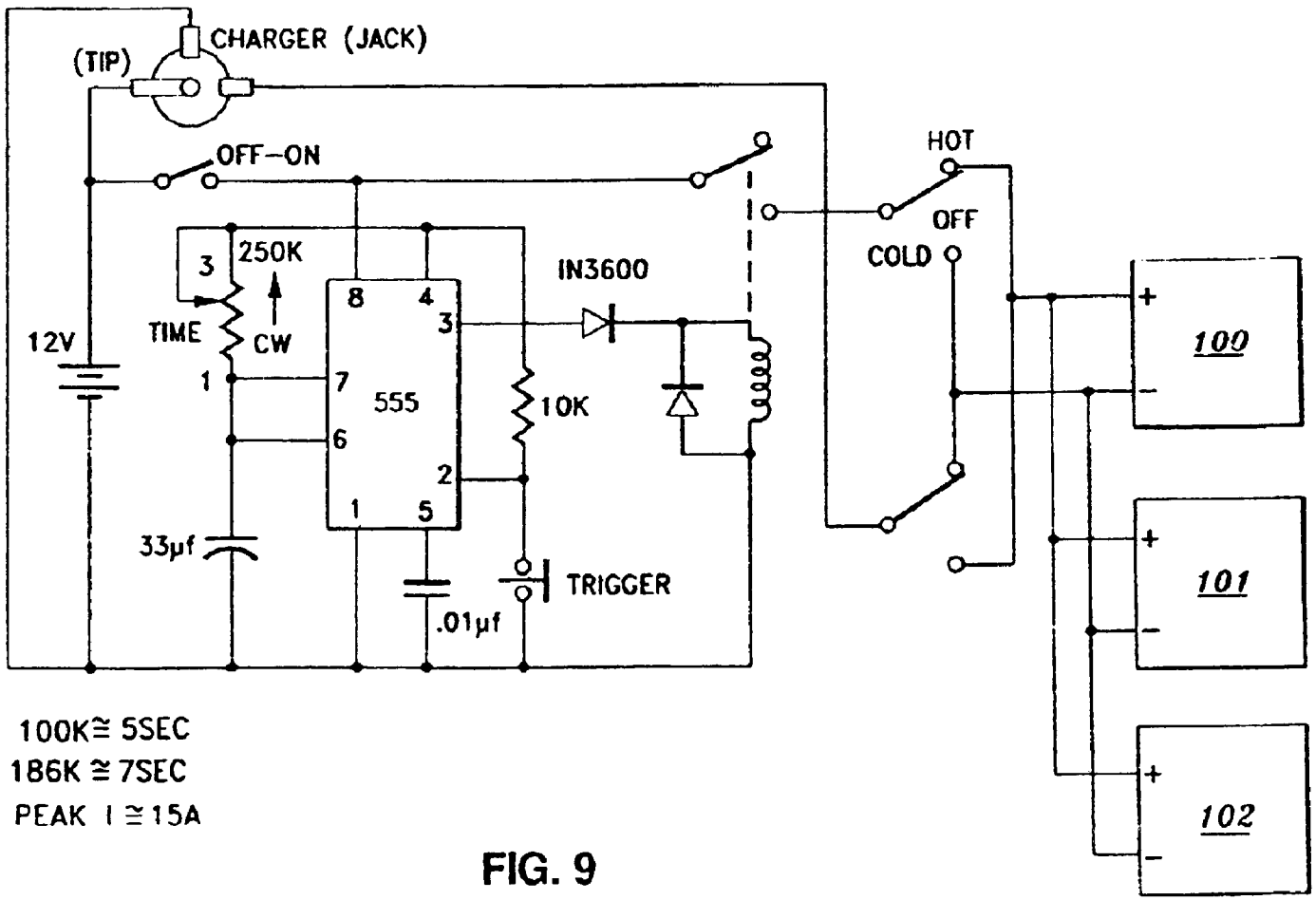
FIG. 9 is a circuit drawing for the control of this invention.

FIG. 9 shows a useful example of control circuit to vary the temperature of a group of thermoelectric cells 100,101, 102. These cells are connected in parallel, the direction of heat flow and thereby the temperature of the surface being observed.

With reference to the drawings, the following is a description of the operation of the circuit.

Turning on power switch S1 energizes the timer consisting of a 555IC operating as a monostable "one shot" The time in seconds is set by RI and CI. RI is adjustable from the left side of box. Clockwise (CW) turning of adjustment increases the time. Time can be set between approximately 0.5 seconds to 10 seconds. Selecting S3 from OFF to HOT or COLD sets the painted surface temperature choice. The timer is triggered by momentarily pushing S2 operating K1 supplying power to the TECs through K1 contacts, which open at the end of the set time. S3 can be switched in the opposite direction and a new cycle initiated if desired. Frequency of cycles is limited by the heatsink capacity. Turning S3 and S1 to OFF removes all power. The battery can be recharged externally through J1 mounted on the right side of box. The battery is a 12V battery.

Conventional Peltier device materials can be used, but in many situations they would be excessively rigid or thick. An alternative construction is proposed by the invention herein, namely structures formed by thin film manufacturing techniques. Such film structures can enhance flexibility, efficiency, temperature ranges, and quick response times.

Conventional thermoelectric devices normally utilize materials such a bismuth telluride with "p" and "n" type semiconductor junctions. Silicon and dopants are included in the basic materials to provide or enhance the semiconductors properties. In addition, conventional technology utilizes brittle ceramic insulating elements and requires inherently thick, rigid construction.

A preferred embodiment for the present invention in thin film planar or fiber form would be to utilize doped silicon carbide as the semiconductor material. Dopants such as bismuth telluride, gallium arsenide, or gallium compounds enhance the "p" and "n" characteristics. Silicon carbide is a majority carrier (also called a wide bandgap semiconductor) which is noted for low leakage current and relatively high temperature stability. Thus high current densities can be supported (compared to silicon).

The thin film silicon carbide Peltier effect layer can best be fabricated by plasma arc deposition essentially the same as that described in Snaper U.S. Pat. No. 5,254,235 which is made a part hereof by reference for its disclosure of this technique. The apparatus and method outlined therein would be identical. Only the deposition materials would differ. Other suitable fabrication methods would include chemical vapor disposition, sputtering, and vacuum deposition.

Compared to silicon or gross bismuth telluride, silicon carbide offers up to four times better thermal conductivity, higher blocking voltage range, and predictable area specific differential resistance. Due to these characteristics, silicon carbide thermoelectric junctions can be made thinner without voltage breakdown limitations (compared to silicon) and can also be effectively paralleled. Silicon carbide also has a practical switching frequency of up to 500 KHz which is desirable should rapid response be desired for some applications.

Radar masking can also be accomplished by the incorporation of radar absorbing particles or dipoles added to the thermochromic paint layer or to the active film. For example very small fibers or particles of materials such as carbon, carbon nonotubes, or conductive metals such as copper or silver in which the particle length is sized to act as a dipole absorber for the general frequency utilized in radar detection or ranging. These materials by a process of absorption, adsorption, multiple internal reflection tend to disperse radar impingement and reduce the amount of direct reflection back to the radar source thus shielding the target from detection to a great extent.

Another unique feature possible is that by controlling the temperature of the thermochromic film containing the radar shielding particles, the particles can be made to expand or contract by controlling the over all film temperature. This minute expansion, and/or contraction with temperature change can effectively lengthen or shorten the dipole particles and thus can be "tuned" for a specific impinging signal. The size change of the temperature controlled particles in most case need only be very minute, perhaps on the order of nanometers, to achieve this effect.

Thermochromic materials are widely used and well-known. For example they are frequently used on oral thermometers. These materials may be incorporated in a paint layer, or they themselves used as a paint layer. The specific product used will be selected for its color at specific temperatures.

As a single example, Tomn Industries, Inc., North Hollywood, Calif. 91436 product # MC-8 is colored black at about below 100 degrees, and colored clear at about above 100 degrees.

Various of these products can be mixed to achieve effects at different temperatures.

This invention is adaptable to respond to commands from its own proprietors, or to incoming signals, and is responsive and adaptive over a wide spectrum range. This frequency range extends from infrared through color to very high frequencies.

For example, if the user is concerned about the IR emission he may change it by program or switching systems actuated by him. Alternatively, sensing an incoming heat seeking missile can cause a response in the system to change the temperature of the surface.

Similar arrangements are useful for color control and color change.

As to radar frequencies, the system can be arranged so that the perceived surface reflects or absorbs as desired. It requires only small dimensional changes in the surface contents to make a surprisingly large difference in radar reflection or absorption.

Such a broad range of adaptability is unknown at the present time.

This invention is not to be limited by the embodiments shown in the drawings and described in the description, which are given by way of example and not of limitation, but only in accordance with the scope of the appended claims.

I claim:

1. A modifier selectively to vary an observed property of an observable surface, said observed property being the resonant frequency of said observable surface with respect to an impinging radar frequency beam, said observable surface overlaying a substrate to be hidden, said modifier comprising:

a Peltier effect thermoelectric cell comprising a thermoelectric semiconductor, and a first and a second electrical conductor on opposite surfaces of said semiconductor, the temperature of said semiconductor surfaces being adjustably variable as the consequence of application of an adjusted charge to said electrical conductor; and a thermally-responsive layer in thermal contact with one of said opposite surfaces of the semiconductor, said thermally responsive layer including in itself particles which change their dimensions with change in temperature, whereby to provide said thermally responsive layer with the property of an adjustable resonant frequency relative to a radar beam impinging on it as a function of the charge applied to the thermoelectric cell.

2. A modifier according to claim 1 in which said Peltier cell occupies a substantial area of said observable surface.

3. A modifier according to claim 1 in which said semiconductor and said first and second electrical conductors are deposited as contiguous layers.

4. A modifier according to claim 3 in which said layers are deposited by vapor deposition, plasma arc or sputtering, applied as a thin film.

5. A modifier according to claim 3 in which said semiconductor comprise silicon carbide.

6. A modifier according to claim 1 in which a plurality of said particles are fibers of carbon, copper or silver.

7. A modifier according to claim 1 in which a plurality of said Peltier cells occupy a substantial area of said observable surface.

* * * * *